United States Patent [19]

Schaefer

[11] 4,173,876

[45] Nov. 13, 1979

[54] METHOD OF PRODUCING METAL TUBING

[75] Inventor: Kenneth A. Schaefer, Brookfield, Wis.

[73] Assignee: Nudyne Corporation, Brookfield, Wis.

[21] Appl. No.: 890,361

[22] Filed: Mar. 27, 1978

[51] Int. Cl.[2] ..... B21D 22/16

[52] U.S. Cl. ..... 72/83; 72/85

[58] Field of Search ..... 72/85, 83

[56] References Cited

PUBLICATIONS

"Tube Spinning" *Metals Handbook* 8th Ed. vol. 4, American Society for Metals, 1969, pp. 317-322.

*Primary Examiner*—Lowell A. Larson

*Attorney, Agent, or Firm*—Andrus, Sceales, Starke & Sawall

[57] ABSTRACT

A method of producing metal tubing, particularly thin-wall, large diameter metal tubing, by clamping one end of a tubular metal blank to a mandrel, rotating the mandrel and blank, and subjecting the blank to both axially and radial deforming pressures through a series of circumferentially spaced rollers to cause the metal of the blank to flow axially ahead of the rollers to reduce the wall thickness of the blank. To achieve the desired thin wall construction without rippling of the internal diameter, the ratio of linear feed of the tubular blank to rotational speed of the blank per inch of tube diameter is maintained in the range of 0.006 to 0.012.

6 Claims, 2 Drawing Figures

METHOD OF PRODUCING METAL TUBING

BACKGROUND OF THE INVENTION

U.S. Pat. No. 3,517,534 describes an apparatus for producing tubes. According to the aforementioned patent, a tubular blank is placed around a mandrel and is clamped in a chuck at one end. A series of circumferentially spaced rollers are moved radially into engagement with the outer surface of the tubular blank while the mandrel and blank are rotated, and at the same time the rollers are moved axially along the blank. This results in the blank being subjected to both radial and axial deforming pressures through the rollers to thereby cause the metal of the tubular blank to flow axially ahead of the rollers to reduce the wall thickness of the blank.

The structure of the aforementioned patent can be used to obtain precision, high pressure tubing with smaller tolerances than standard mill drawn tubing in diameters ranging from 3 inches up to 10 inches, and this is accomplished by "spin forging" with no metal removal from the metal tubular blank.

However, certain difficulties have arisen in the past when attempting to spin forge larger diameter thin wall tubing, due to the problem of rippling on the internal diameter of the tube.

SUMMARY OF THE INVENTION

The invention relates to a method of producing metal tubing, and more particularly to producing thin wall, large diameter tubing, by spin forging. In accordance with the method of the invention, the tubular metal blank is placed on a mandrel, and one end of the blank is clamped within a chuck. The mandrel and blank are rotated about the axis of the blank, and a series of circumferentially spaced rollers are brought into contact with the outer surface of the blank, while moving axially of the blank. The combination of both radial and axial deforming pressure serves to flow the metal forwardly, ahead of the rollers, and reduce the wall thickness of the blank, as the blank is compressed against the mandrel.

In accordance with the invention, the desired thin wall characteristics are obtained without rippling of the internal diameter by utilizing a specific ratio of linear feed, in inches/minute, to rotational speed in revolutions per minute. It has been found that this ratio should be in the range of 0.006 to 0.012 per inch of tube diameter.

By maintaining the feed and rotation speed within this precise ratio, the tubular blank can be reduced in wall thickness to produce thin wall larger diameter tubes, which previously could not be formed without rippling or other defects on the internal or external diameters.

While the invention has particular application to forming thin wall, large diameter tubes, it can be used to produce finished tubes having diameters in the range of 3 to 20 inches. Finished wall thicknesses in the range of about 0.100 to 0.150 inch can be obtained for blanks with diameters in the range of 6 to 9 inches, while wall thicknesses in the range of 0.125 to 0.250 inches can be obtained for larger diameter tubes, having diameters in the range of 10 to 12 inches.

Other objects and advantages will appear in the course of the following description.

DESCRIPTION OF THE DRAWINGS

The drawings illustrate the best mode present contemplated of carrying out the invention.

In the drawings.

DESCRIPTION OF THE PREFERRED EMBODIMENT

The method of the invention can be carried out by the apparatus shown in U.S. Pat. No. 3,517,534 and the structure and operation of the apparatus of that patent is incorporated herein by reference.

Figure 1:
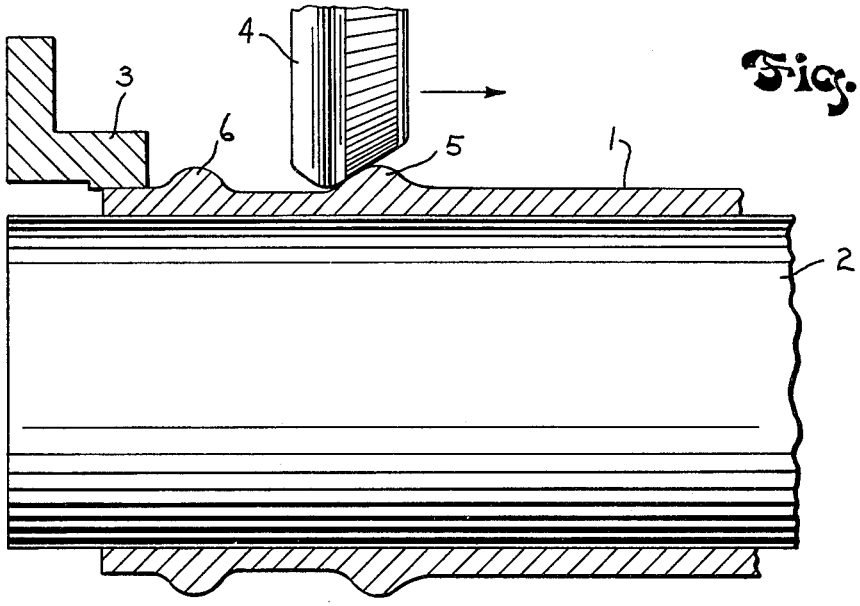
FIG. 1 is a diagrammatic view showing the method of the invention.

As shown in FIG. 1, the tubular blank 1 to be spun forged is placed around a cylindrical mandrel 2 and one end of the tube is clamped in a chuck 3. The opposite end of the mandrel is engaged with a tail stock center, not shown.

As described in the aforementioned patent, while the mandrel and blank are rotated about the axis of the blank, a series of circumferentially spaced rollers 4 are moved radially inward as well as axially of the tubular blank 1 to cause the metal of the tubular blank to flow forwardly in the direction of movement of the rollers in an annular plastic flow area 5. The initial point of contact of the rollers with the metal blank causes a rearward metal flow which results in the ridge or collar 6.

It has been discovered that in order to produce thin wall, large diameter tubing without any rippling effect on the internal diameter that a specific relationship between the axial feed of the rollers in inches/minute and the rotational speed of the mandrel in RPM is required. More specifically, the ratio of linear feed to rotational speed per inch of tube diameter should be in the range of 0.006 to 0.012. If the feed and rotational speed are maintained within this range, it has been found that a substantial reduction in wall thickness can be achieved without deformation or rippling of the inner or outer diameters of the tube.

The tubular blank is a welded steel tube having a carbon content in the range of 0.10 to 0.26% and prior to the spin forging operation, is normalized at a temperature in the range of about 1700° F. to 1750° F. The normalized tubular blank will generally have a certain degree of eccentricity or ovality, in the range of 0.032 to 0.125, and will not be precisely straight.

For most operations, three circumferentially spaced rollers 5 are utilized, although for larger diameters of 10 to 12 inches, four rollers are preferred. The use of the fourth roller enables the same linear feed to rotational speed ratios to be used as with the smaller diameter tubes. One would expect that the use of the fourth roller would require additional power to maintain a given feed rate, or alternately would necessitate a slower feed rate for the same power input. However, this has been found not to be the case, for the use of the fourth roller on large diameter tubes does not require additional power to maintain a given feed rate.

Figure 2:
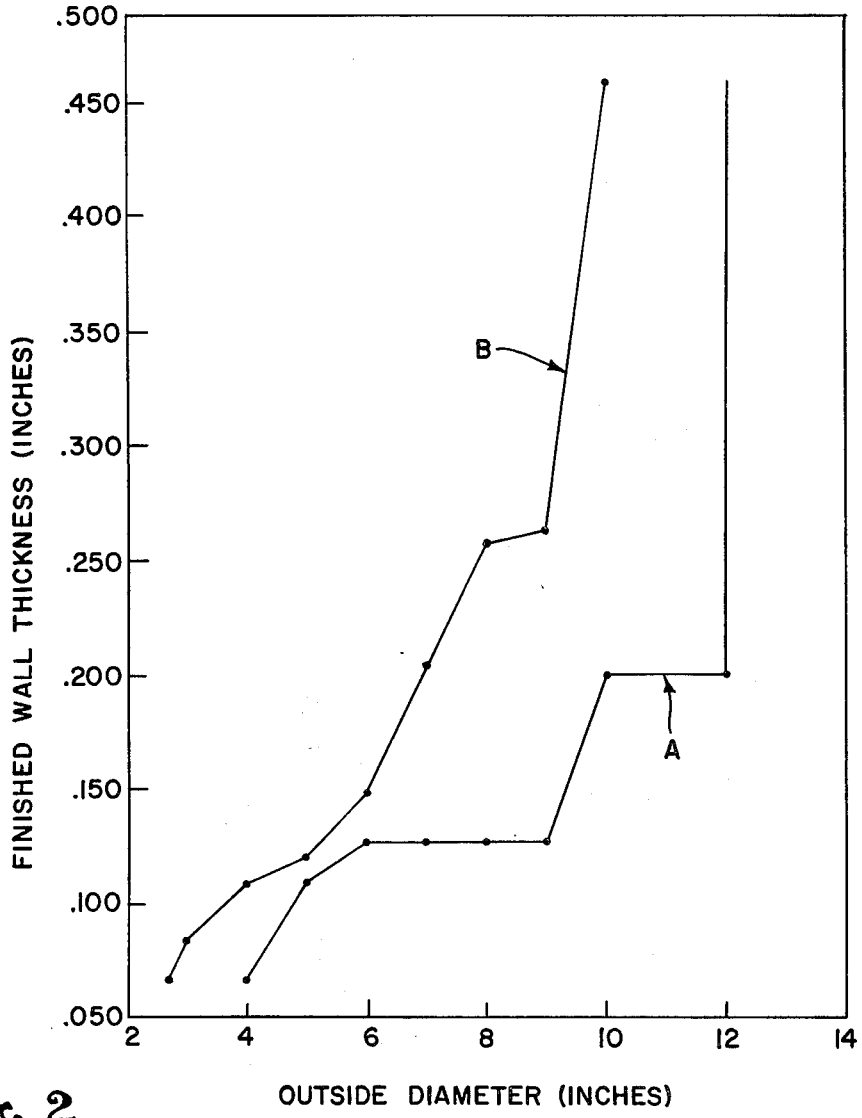
FIG. 2 is a graph showing the range of wall thicknesses for various diameter tubes that can be obtained through use of the invention, represented by Curve A, as compared with standard mill drawing tubing, represented by Curve B.

FIG. 2 is a graph showing the wall thicknesses obtainable for various diameter tubes through use of the method of the invention as compared with standard mill drawn pipe. Curve A in FIG. 2 shows the minimum wall thickness for tubes having an OD of 4 to 12 inches as fabricated by the method of the invention, while Curve B shows the minimum wall thicknesses for standard mill drawn tubing having an OD of 3 to 10 inches. By comparing the Curves, it is seen that the minimum wall thickness for all diameters of tubes produced by the method of the invention is less than that of standard mill drawn pipe. This is particularly evident when dealing with 10 inch diameter pipe, for the minimum wall thickness for tubes made in accordance with the invention is approximately 0.195 inch, while 10 inch mill drawn pipe has a mimimum thickness of about 0.460 inch. Furthermore, standard mill drawn pipe cannot be obtained in 12 inch diameter.

The following examples illustrate the method of the invention.

EXAMPLE I

To produce a 90 inch long finished tube, an electric resistance welded tubular blank having an 8.875 inch OD, 0.440 inch wall thickness and a length of 47 inches was normalized to produce a tensile strength of 50,000 psi and a yield strength of 39,000 psi. The tubular blank was then spin forged, as outlined above, using three circumferentially spaced rollers, an axial feed rate of 18 in/min. and a rotation speed of 237 rpm, or a ratio of 0.076. After two passes, the properties of the finished tube were as follows, as compared with a standard mill drawn pipe of similar diameter.

| | Tube fabricated by the method of the invention | Standard mill drawn tube |
|---|---|---|
| ID | 8.000 ± 0.003 | 8.000 ± 0.025 |
| OD | 8.448 ± 0.004 | 8.500 ± 0.025 |
| Ovality | 0.006 | 0.045 |
| Wall Thickness | 0.218 ± 0.002 | 0.260 ± 0.007 |
| Straightness | 0.003/ft. | 0.020/ft |
| RMS | 15–25 | 40–80 |
| Yield Strength | 83,000 psi | 60,000 psi |
| Tensile Strength | 96,700 psi | 70,000 psi |
| Elongation | 15.6% | 8–10% |

EXAMPLE II

An electric resistance welded tube having a 10.75 inch OD, 0.365 inch wall thickness and a length of 47 inches was subjected to the spin forging treatment utilizing an axial feed rate of 12 in./min. and a rotation speed of 237 rpm. A two-pass process was employed.

The finished tube had the following properties as compared with a standard mill drawn pipe of similar diameter.

| | Tube fabricated by the method of the invention | Standard mill drawn tube |
|---|---|---|
| ID | 10.006 ± 0.008 | 10.000 ± 0.034 |
| OD | 10.483 ± 0.010 | 10.500 ± 0.034 |
| Ovality | 0.016 | 0.055 |
| Wall thickness | 0.240 ± 0.002 | 0.284 ± 0.005 |
| RMS | 15–30 | 40–80 |

Various modes of carrying out the invention are contemplated as being within the scope of the following claims particularly pointing out and distinctly claiming the subject matter which is regarded as the invention.

We claim:

1. A method of making metal tubes, comprising the step of producing a welded steel tubular blank having a diameter greater than 6 inches and having a longitudinal weld seam, disposing the tubular blank without prior machining on the outer surface of a cylindrical mandrel, applying radial pressure through a plurality of circumferentially spaced rollers to the outer surface of the tubular blank, affecting relative linear feeding movement between the rollers and the tubular blank, effecting relative rotational movement between the rollers and the tubular blank the axis of said blank, the combination of linear and rotational movement acting to reduce the wall thickness of the tubular blank to a final wall thickness in the range of 0.110 to 0.250 inch, and maintaining a ratio between the speed of linear movement in inches per minute and the speed of rotational movement in revolutions per minute per inch of tube diameter in the range of 0.006 to 0.012.

2. The method of claim 1, wherein the step of effecting relative linear feeding movement is achieved by moving the rollers axially along the tubular blank, and the step of effecting relative rotational movement is achieved by rotating the blank about the axis of said blank.

3. The method of claim 3, and including the step of normalizing the welded structure prior to disposing the tubular blank on the mandrel.

4. The method of claim 1, wherein the carbon content of the tubular blank is in the range of 0.10 to 0.260%.

5. The method of claim 1, wherein the tubular blank has an external diameter in the range of 10 to 12 inches and the final wall thickness of the blank is in the range of 0.125 to 0.250 inch.

6. The method of forming metal tubes, comprising the step of disposing a longitudinally welded tubular blank having an eccentricity in the range of 0.032 to 0.125 inch on a cylindrical mandrel, clamping one end of the blank to the mandrel, engaging a series of circumferentially spaced rollers with the outer surface of the blank, moving the rollers axially of the blank while rotating the mandrel and blank about the axis of the blank to thereby reduce the wall thickness of the blank to a value in the range of 0.110 to 0.250 inch and provide a finished tube, and maintaining the ratio of axial movement in inches per minute to rotation speed in revolutions per minute per inch of tube diameter in the range of 0.006 to 0.012.

* * * * *

UNITED STATES PATENT AND TRADEMARK OFFICE

CERTIFICATE OF CORRECTION

PATENT NO. : 4,173,876

DATED : November 13, 1979

INVENTOR(S) : KENNETH A. SCHAEFER

It is certified that error appears in the above-identified patent and that said Letters Patent are hereby corrected as shown below:

Column 4, line 26, CLAIM 1, After "blank", first occurrence, insert ---about---, Column 4, line 40, CLAIM 3, Cancel "3" and substitute therefor ---1---.

Signed and Sealed this

*Fifteenth* Day of *April 1980*

[SEAL]

*Attest:*

SIDNEY A. DIAMOND

*Attesting Officer*

*Commissioner of Patents and Trademarks*